US006689041B2

(12) United States Patent
Lanvin et al.

(10) Patent No.: US 6,689,041 B2
(45) Date of Patent: Feb. 10, 2004

(54) FOLDING JAW ARRANGEMENT ON PRINTED PRODUCT-PROCESSING FOLDING CYLINDERS

(75) Inventors: Serge Lanvin, Cires les Mello (FR); Jean Francois Robert, Creil (FR); Philippe Robin, Cires les Mello (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 54 days.

(21) Appl. No.: 09/989,629

(22) Filed: Nov. 20, 2001

(65) Prior Publication Data

US 2002/0066380 A1 Jun. 6, 2002

(30) Foreign Application Priority Data

Nov. 27, 2000 (DE) ..... 100 58 758

(51) Int. Cl.[7] ..... B31F 1/08

(52) U.S. Cl. ..... 493/428; 493/424; 493/427; 493/432

(58) Field of Search ..... 493/428, 424, 493/427, 432, 434, 444

(56) References Cited

U.S. PATENT DOCUMENTS

| | | | | |
|---|---|---|---|---|
| 4,218,053 A | * | 8/1980 | Heimlicher | |
| 4,231,559 A | * | 11/1980 | Weschenfelder et al. | 493/432 |
| 5,921,906 A | * | 7/1999 | Nagano | 493/428 |
| 6,038,974 A | | 3/2000 | Richards | 101/232 |
| 6,159,138 A | | 12/2000 | Lanvin et al. | 493/359 |
| 6,234,947 B1 | * | 5/2001 | Michalik | 493/434 |
| 6,280,373 B1 | * | 8/2001 | Lanvin | |

FOREIGN PATENT DOCUMENTS

| | | |
|---|---|---|
| DE | 435594 | 8/1924 |
| DE | 623219 | 11/1935 |
| DE | 2745359 | 4/1979 |
| DE | 4412142 | 10/1995 |
| EP | 0931748 | 7/1999 |
| EP | 0931747 | 12/2000 |
| FR | 1505567 | 12/1967 |
| GB | 1349646 | 4/1974 |

* cited by examiner

*Primary Examiner*—Eugene Kim
*Assistant Examiner*—Sameh Tawfik
(74) *Attorney, Agent, or Firm*—Davidson, Davidson & Kappel, LLC

(57) ABSTRACT

A folding jaw arrangement (11) at a lateral surface (9) of a product-carrying cylinder (10) in folding apparatuses. The folding jaw arrangement (11) includes a stationary folding jaw part (13) and a movable folding jaw part (14). Formed therebetween is a gap (12) into which a folding means (5) of further cylinder (4) co-operating with the product-carrying cylinder (10) plunges during the cross-folding of products. In the process, the product to be cross-folded passes from the further cylinder (4) to the lateral surface (9) of the product-carrying cylinder (10) and is held thereon by the folding jaws (11). The movable folding jaw part (14; 29, 40) is provided with resilient regions (20, 27) via which the product is brought into and held in contact (15) with the stationary folding jaw part (13) of the folding jaw arrangement (11).

14 Claims, 5 Drawing Sheets

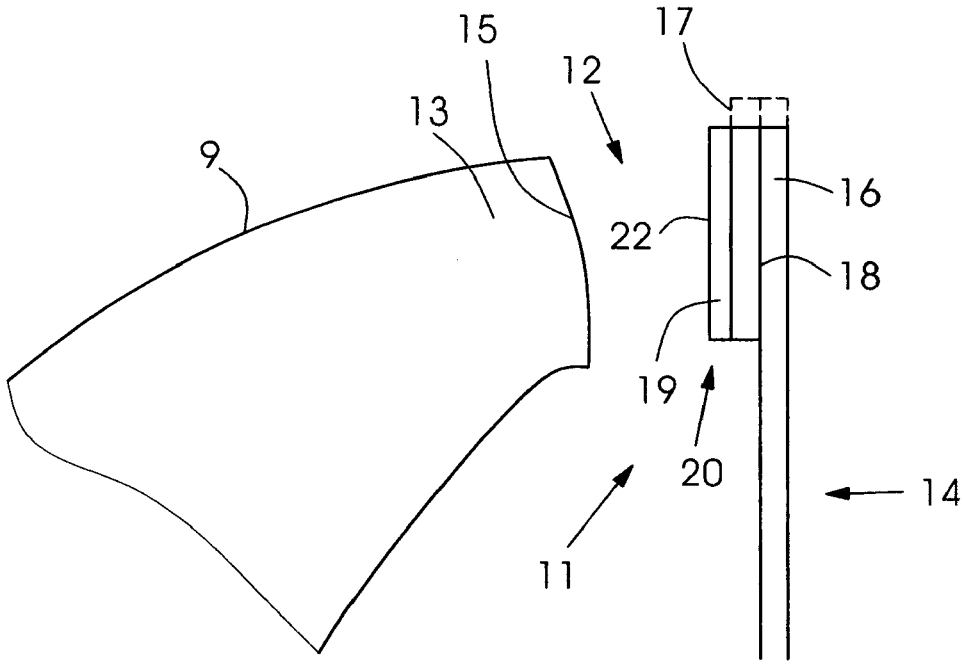
Fig.5.1
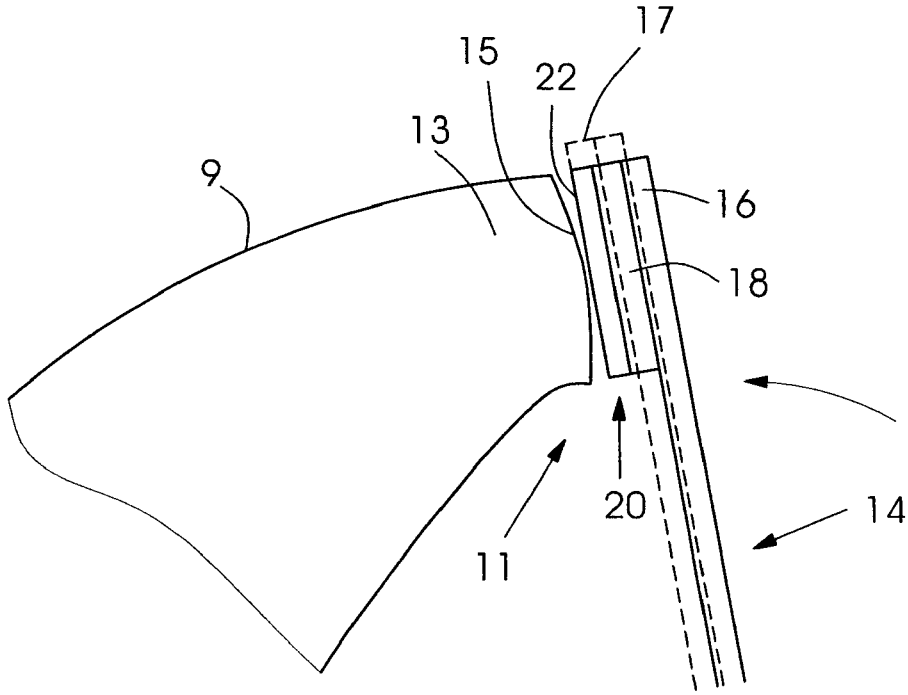
Fig.5.2

FOLDING JAW ARRANGEMENT ON PRINTED PRODUCT-PROCESSING FOLDING CYLINDERS

Priority to German Patent Application No. 100 58 758.5, which is incorporated by reference herein, is hereby claimed.

BACKGROUND OF THE INVENTION

The present invention relates to a folding jaw arrangement on product-processing folding cylinders such as a folding jaw cylinder which receives printed products during cross-folding in a folding apparatus.

European Patent Applications EP 0 931 747 A1 and EP 0 931 748 A1 relate to folding apparatuses for rotary printing presses which process material webs. A folding blade cylinder rotating about its axis co-operates with a cutting cylinder which includes additional guide devices in the region of the cutting blade bearing arrangement. The retraction and extending movements of gripper devices on the first copy-carrying cylinder and on the cutting cylinder co-operating with the first copy-carrying cylinder take place parallel between the normals to the lateral surfaces of the cylinders which co-operate with one another.

Via additional holding devices accommodated at the periphery of the cutting cylinder in the vicinity of the cutting blade bearing arrangement thereof, the leading edges of products which are cut off in the cutting gap are pressed onto the peripheral surface of a rotating folding blade cylinder accommodated opposite before they are gripped over at the leading edge by the grippers thereof and, in this manner, are fixed onto the lateral surface of the folding blade cylinder. Thereupon, the holding devices move back into the peripheral surface of the cutting cylinder while the cutting cylinder continues to rotate.

U.S. Pat. No. 6,038,974 relates to a deceleration device co-operating with a folding jaw cylinder. A deceleration device contains five gripper devices which in each case pick up the leading edges of products which are cut off in the cutting gap. Allocated to the gripper devices which constitute the deceleration units are in each case extendable folding blades whose extending movement at the lateral surface is coupled with the release of the leading edge of the copy by the gripper devices. The deceleration device includes five separate arms which can be decelerated in their circumferential speed in such a manner that the products which are grasped by gripper devices provided on the arms overlap one another. At the moment of the extension of the cross-folding blades and of the release of the holding devices, the circumferential speeds of the transferring deceleration devices and that of the folding located opposite jaw correspond to each other.

German Patent No. 44 12 142 C2 relates to a folding apparatus including a gripper- and folding blade cylinder which features a first gripper and a first folding blade as well as a gripper- and folding jaw cylinder which features second gripper- and folding jaw stations for conveying sheets for book production or for making a fold for the cross-fold production in sheets. According to this proposed design approach, the gripper- and folding blade cylinder is constituted by only one cylinder body. The folding jaw stations and the second grippers on the gripper- and folding jaw cylinder are accommodated at a fixed distance from each other. This distance is formed by the sum of half of the length of the sheets, half of the length of the maximum possible pre-fold, and of an additional length. The additional length is made up of the distance between the leading edge of the sheets and the trailing edge of the second grippers as well as a safety margin. The gripper- and folding blade cylinder features a first cylinder body which carries the folding blades and which is coupled to the drive gear of the gripper- and folding jaw cylinder via a gear wheel. Furthermore, this gripper- and folding blade cylinder features a second cylinder body which carries the first grippers, it being possible the two cylinder bodies to be rotated relative to each other during the change-over between book production and cross-fold production.

SUMMARY OF THE INVENTION

The object of the present invention is to improve the holding of printed products in folding jaws during the product transfer from one cylinder surface to another cylinder surface.

The present invention provides a folding jaw arrangement (11) on a folding jaw cylinder (10) in a folding apparatus of a rotary printing press, comprising a stationary folding jaw part (13) and a movable folding jaw part (14; 29, 40) between which a gap (12) is formed into which a folding device or means (5) of a further cylinder (4) co-operating with folding jaw cylinder (10) plunges for folding the products. The movable folding part (14; 29, 40) is provided with resilient regions (20, 27) which press the product against the stationary part (13) during the folding process.

The advantages which can be attained using the design approach proposed according to the present invention are to be seen above all in that, by designing the movable folding jaw part to have resilient regions, on one hand, a holding force which is adapted to the spine thickness of the folded signatures can be produced for the specific product in the folding jaw arrangement configured according to the present invention and, on the other hand, it is guaranteed that by the extending movement of the folding means, for example the folding blade, accommodated at the opposite cylinder, it is prevented that layers of a sheet-like product formed of a plurality of layers are ejected from the folding jaw or that the edges of the layers of the product which are in immediate contact with the folding means are folded over. The resilient regions of the movable folding jaw which produce the individual holding force on the stationary folding jaw depending on the product thickness are preferably arranged in such a manner that they are located in the regions at the periphery of the folding jaw cylinder which, in the case of cylinders working without pins, are encircled by conveyer belts and are disposed such that they correspond to recesses which are provided on the folding means and which facilitate the retraction movement of the folding means from the folding jaw gap with the product being in the pushed in position.

In a variant of an embodiment, the movable folding jaw part can include a plurality of folding jaw sections extending over the width of the folding jaw cylinder. The folding jaw sections can be demountably arranged on a folding jaw shaft which jointly drives all folding jaw sections and which is controlled such in a manner that is phased with the entering movement of the folding means of the product-transferring cylinder, for example, via a roller/cam control or an individual electric drive at the folding jaw cylinder. The individual sections constituting the movable folding jaw can be arranged on the folding jaw shaft in such a manner that clearances are formed between the individual folding jaw sections, the clearances corresponding to the respective positions of lifter elements entering into longitudinal grooves at the lateral surface of the folding jaw cylinder.

In another variant of an embodiment of the basic idea of the invention, it is also possible for the movable folding jaw part to be formed in one piece. The folding jaw formed in one piece can also be replaceably accommodated on a shaft which can be actuated via a roller/cam control or via an individual electric drive.

In a preferred variant of an embodiment of the movable folding jaw part, whether it is composed of a plurality of sections or formed in one piece, the resilient regions are designed as resilient tongues which are bounded by slot-shaped openings. The contact force exerted by the resilient tongues upon the folding spine of the product which is pushed into the folding jaw can be predetermined via the length of the slot-shaped openings in the individual folding jaw sections or in the movable folding jaw part formed in one piece. At the individual resilient regions which are designed, for example, as resilient tongues, additional coatings can be applied with overthickness, i.e., increased material thickness, the coatings narrowing the open folding jaw gap.

In a preferred embodiment, the coatings at the movable folding jaw part are manufactured with overthickness, i.e., increased material thickness, from a material containing an elastic, flexible material. Via the thickness of the coating, it is also possible to predetermine the contact force of the folding spine pushed into the folding jaw upon the opposite contact surface of the stationary folding jaw part. The pointwise introduction of the holding force at the spine of the folded product pushed into the folding jaw prevents the occurrence of marking phenomena, in particular in the case of multilayer, thicker product spines. The additional coating in the region of the resilient regions of the movable folding jaw part can be composed, for example, of a polyurethane.

The coating which is thickened in its material thickness is applied at the movable part of the folding jaw arrangement proposed according to the present invention preferably in the portion of the movable part of the folding jaw which portion faces the lateral surface of the product-carrying cylinder, i.e., of the folding jaw cylinder. Besides the possibility of applying the additional coating which narrows the folding jaw gap in the open condition directly to the movable folding jaw part, whether it is a section or a movable folding jaw part formed in one piece, it is also possible for the additional coating to be applied to an intermediate layer. The intermediate layer between the movable folding jaw part and the additional coating is preferably also manufactured from an elastic material, the coating thickness thereof exceeding the thickness of the outer coating on the movable folding jaw part.

The folding jaw arrangement according to the proposed invention which is embedded in the lateral surface of a product-carrying cylinder is run through by longitudinal grooves in the regions in which the products which are held cross-folded in the folding jaws at the lateral surface of the product-carrying cylinder are removed from the lateral surface by stationarily arranged lifters. To permit passage of the lifter elements which plunge into the longitudinal grooves and whose entering depth into the longitudinal grooves is preferably adjustable, both the stationarily accommodated folding jaw part and the movably accommodated folding jaw part are provided with clearances which allow the lifter tips to pass through the folding jaw.

The resilient regions formed with overthickness in the top region on the movable folding jaw part preferably correspond to recesses which are formed on the folding means, i.e., the folding blade, entering into the folding jaw gap. In this manner, on one hand, it is possible to permit a sufficiently deep entering of the folding means into the folding jaw gap which is open but narrowed in its width; on the other hand, it can be achieved by this selected configuration that the cross-folded folding spines of the cross-folded products which spines are received in the folding jaw gap are already pressed onto the stop face of the stationary part of the folding jaw by the resilient sections of the movable folding jaw part during the closing of the folding jaw, i.e., that the product is already held while the retraction movement of the folding means moving back from the folding jaw gap still continues.

The folding jaw arrangement proposed according to the present invention can preferably be used on product-carrying cylinders such as a folding jaw cylinder. Such a folding jaw cylinder can be employed both on folding apparatuses working with pins and on folding apparatuses working without pins which are arranged downstream of web-fed rotary printing presses, whether they are commercial web presses or newspaper printing presses.

BRIEF DESCRIPTION OF THE DRAWINGS

In the following, the present invention will be explained in greater detail with reference to the drawings, in which:

FIG. 5.1 shows a folding jaw in the open condition; and

FIG. 5.2 shows a deflected movable folding jaw part making contact with the stationary folding jaw.

DETAILED DESCRIPTION

Figure 1:
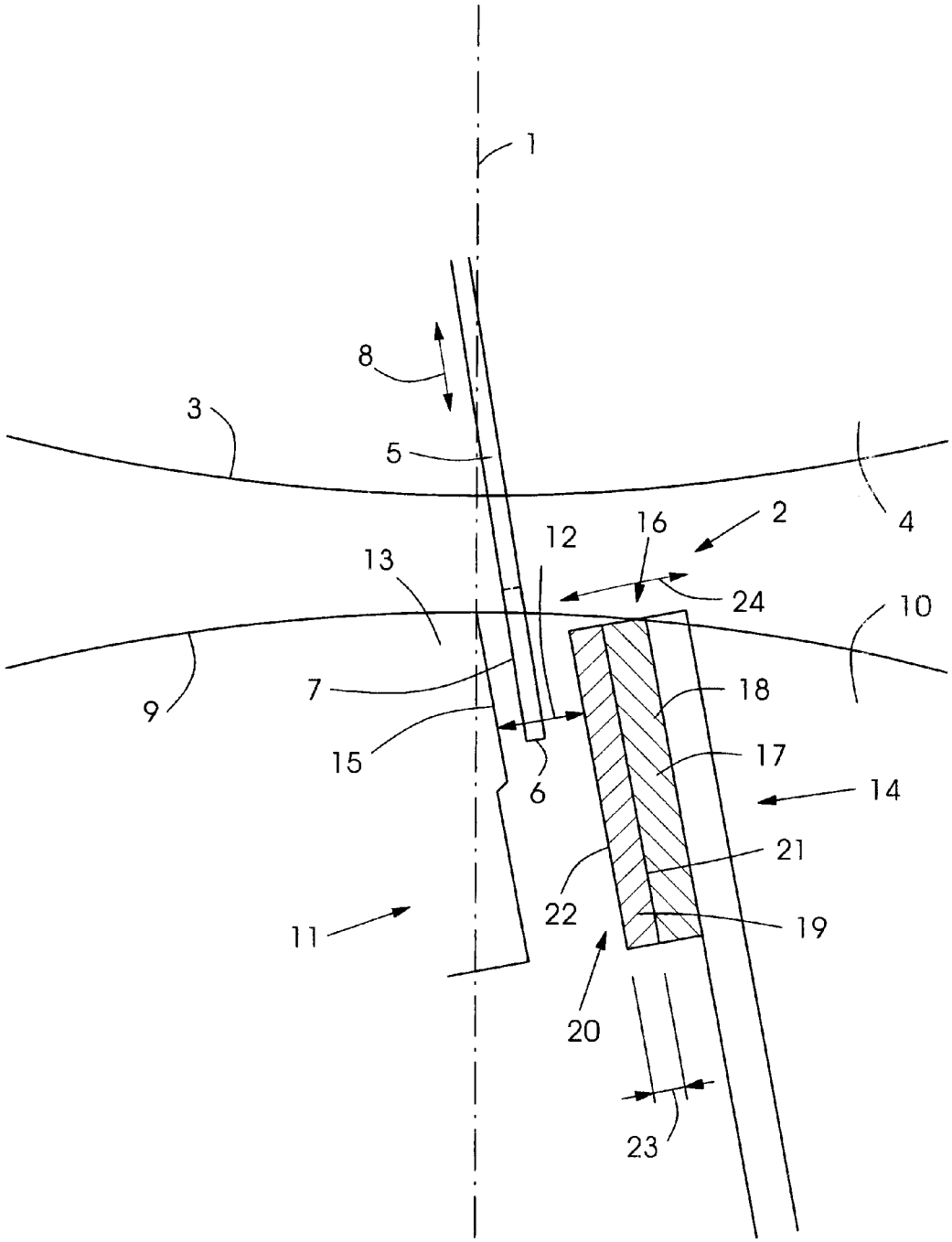
FIG. 1 shows a folding means in the form of a folding blade entering into an open folding jaw gap between the stationary and the movable folding jaw parts.

The representation according to FIG. 1 reveals a cross-folding blade entering into an open folding jaw gap bounded by a stationary and by a movable folding jaw part.

Both a retractable and an extendible folding means or device 5 in the form of a folding blade and a folding jaw arrangement 11 are accommodated in such a manner that they are slightly inclined toward normal 1 between a lateral surface 3 of a folding blade cylinder and lateral surface 9 of a product-carrying cylinder 10. At lateral surface 3 of the folding blade cylinder, printed products, such as signatures, to be folded, which are held on lateral surface 3 by gripper devices which are not shown here, enter into a transfer gap 2 between lateral surface 3 and lateral surface 9, the narrowest cross-section thereof being situated in the region of normal 1. The gap width of transfer gap 2 is dimensioned such that, in the case of multilayer products to be subjected to a cross-folding process, it is just sufficient to permit the flutter-free passage of the layers of the product. At the time of the cross-folding process, i.e., of the extension of the folding means in the form of a folding blade 5 on lateral surface 3 of folding blade cylinder 4, folding jaw arrangement 11 is open, i.e., the width of folding jaw gap 12 is maximal. Folding blade 5 plunges into open folding jaw gap 12 with its folding blade tip 6 which can be interrupted by individual recesses 7 extending over the width of folding blade 5. In the process, the region of the product which covers tip 6 of folding blade 5, that is the later folding spine, is pushed into folding jaw arrangement 11. Folding jaw arrangement 11 includes a stationary part 13 which constitutes a stop face 15 of folding jaw arrangement 11. Movably accommodated is a folding jaw part 14 which is movable relative to the stationary part and which describes a movement according to arrow 24. Movable part 14 of folding jaw arrangement 11, which will hereinafter also be referred to as movable folding jaw, can either be formed of individual sections 29 (FIG. 2) which are spaced from each other in an axial direction and which are accommodated on a folding jaw shaft which jointly actuates sections 29 or, equally, movable folding jaw 14 can also be made as a one-piece component. The folded spine of the single- or multilayer folded product which spine is formed by pushing folding blade 5 into open folding jaw gap 12, on one hand, lies against stop face 15 of stationary folding jaw 13 and is held thereon by a closing travel, i.e., an approach movement of movable part 14 of folding jaw arrangement 12 narrowing the cross-section of folding jaw gap 12.

According to the proposed folding jaw arrangement, movable folding jaw part 14 is preferably constituted by a flat-spring-shaped element which can be provided with an intermediate coating or intermediate layer 17 in a region facing lateral surface 9 of product-carrying cylinder 10. Intermediate coating 17 is preferably manufactured from a flexible, elastic material and is joined to movable folding jaw part 14 at its back 18 while at front 19 of intermediate layer 17, an additional coating 20 is accommodated. Additional coating 20 which is accommodated on intermediate layer 17 or formed directly on the flat-spring-shaped folding jaw part 14 preferably has a material thickness 23 of only a few tenths of a millimeter. Side 22 of coating 20 facing the product is preferably composed of a material which has a surface having a good grip, preferably having a coefficient of friction which exceeds the coefficient of friction of the material to be grasped of the sheet-like products. Thickness 23 of additional coating 20, made of flexible material such as polyurethane or of a wear-resistant material such as, for example, sapphire or a similar material, is markedly thinner in comparison with intermediate layer 17 whose thickness can be in the range of several mm.

Figure 2:
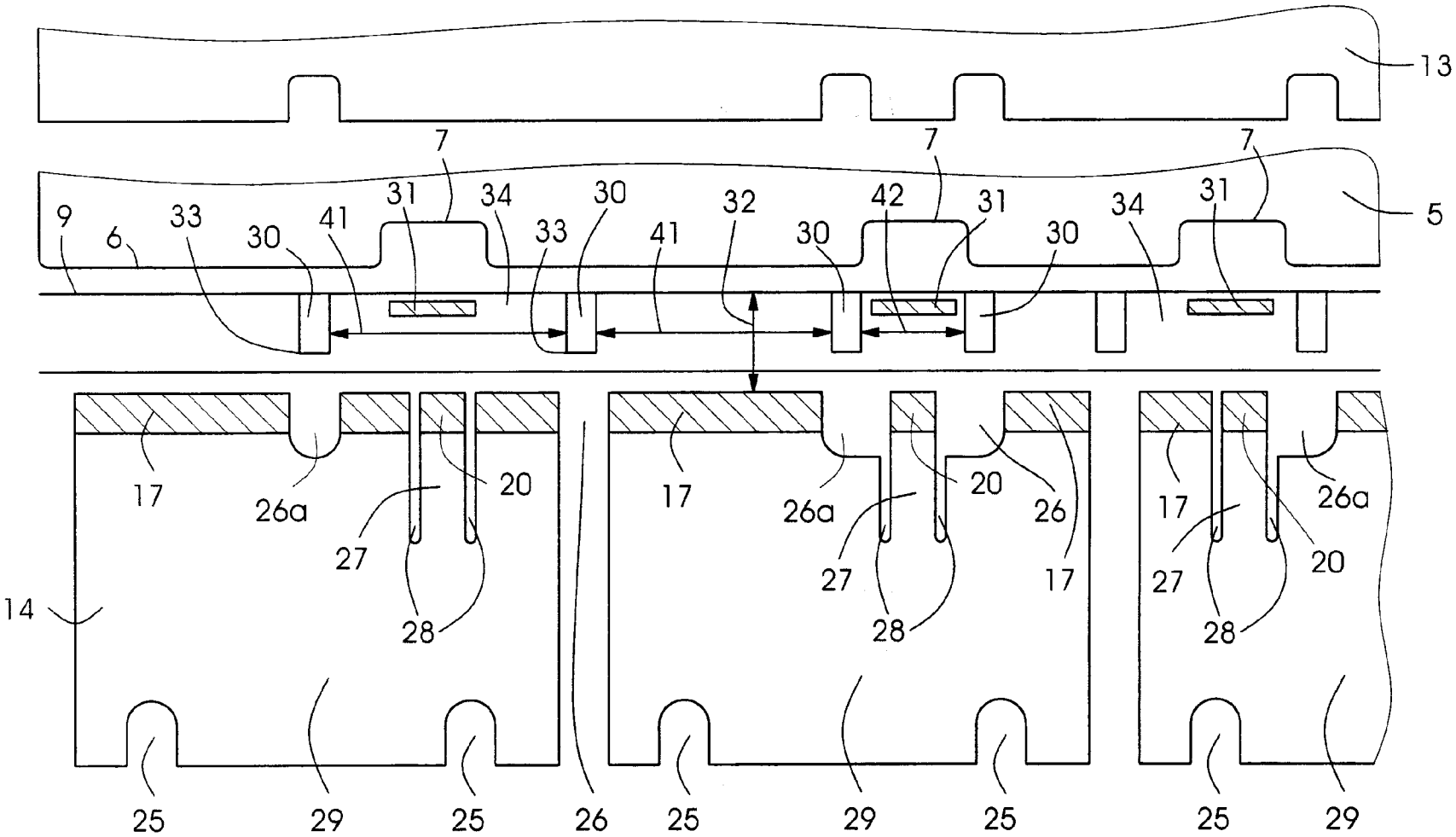
FIG. 2 shows a developed view of the stationary folding jaw, cross-folding blade, lateral cylinder surface, and movable folding jaw part in the transfer region of the products.

The representation according to FIG. 2 illustrates in greater detail a developed view of the stationary folding jaw, folding means, lateral cylinder surface, and the movable folding jaw part.

This representation, in which folding jaw arrangement 11 is shown unfolded, reveals in greater detail the geometry, in particular the axial extension perpendicular to the drawing plane according to the representation from FIG. 1. In this representation, it is discernible that movable folding jaw part 14 can be composed of a plurality of folding jaw sections 29 which are spaced from each other and accommodated with clearance from one another on a shaft which is not shown here. In this variant of an embodiment, the spacing of the individual folding jaw sections 29 of movable folding jaw part 14 can be selected in such a manner that clearances 26 ensue between the individual butt joints of the sections into which tips of lifter or stripper elements 30, 33 which are preferably provided in lateral surface 9 of product-carrying cylinder 10 can plunge without making contact. In the variant of an embodiment of movable folding jaw part 14 according to FIG. 2, it is also possible to provide the individual sections 29 of movable folding jaw part 14 with clearances 26*a* into which the tips of lifter elements 30, 33 plunge without making contact. The individual lifter elements, whose entering depth 32 can be variably selected with respect to lateral surface 9 of product-carrying cylinder 10, i.e., of the folding jaw cylinder, are set apart at a first distance 41 or, being closer to one another, at a smaller spacing 42.

The resilient regions of movable folding jaw part 14 which are provided with coatings having overthickness are preferably designed as resilient tongues 27. Resilient tongues 27 on the individual sections 29 of the movable folding jaw part are bounded by slot-shaped openings 28 essentially extending in a vertical direction. The contact forces which can be attained via resilient tongue 27 on the folding spine and on the stationary contact surface 15 (FIG. 1) of stationary part 13 of folding jaw arrangement 11 which stationary contact surface is situated opposite of the movable folding jaw part arise as a function of the slot depth of slot-shaped openings 28 in the material of section 29 of movable folding jaw part 14. In this specific embodiment, the region, which faces lateral surface 9, of movable folding jaw part 14 is provided with an intermediate layer 17. In the region of resilient tongue 27, intermediate layer 17 is provided with a rectangularly configured section of an additional coating. This coating 20 shown in an enlarged view in FIG. 1 narrows folding jaw gap 12 as is illustrated in greater detail in the representation according to FIG. 1. If, at lateral surface 9, stripper elements entering therein are disposed side by side at a smaller spacing 42, then clearances 26, which can be situated adjacent to a tongue 27 having a resilient design, ensue on folding jaw sections 29 of movable folding jaw part 14. Because of this, slot-shaped openings 28 bounding this resilient region 27 of movable folding jaw section 29 turn out to be smaller without thereby impairing the stiffness, that is, the contact forces to be produced.

Using openings 25 formed at the lower side of folding jaw sections 29, it is possible for the individual folding jaw sections 29 to be detachably fastened to a common actuating shaft. By means of the shaft which can be actuated via a roller/cam control, it is guaranteed that movable folding jaw part 14, here composed of individual sections 29, is brought into contact with contact surface 15 of stationary folding jaw part 13 with the product in the pushed-in condition in folding roller gap 12. In the representation according to FIG. 2, reference numerals 31 denote conveyer belts which are depicted moving into lateral surface 9 of product-carrying cylinder 10. Due to the position of conveyer belts 31, 38 with respect to lateral surface 9 of product-carrying cylinder 10, folding means 5 entering folding jaw gap 12 is required to have recesses 7 so as not to damage conveyer belts 31, 38 during the process of pushing the product spine into open folding jaw gap 12. The positions of the individual resilient regions 27, whether on folding jaw section 29 or on a movable folding jaw part 14 formed in one piece, are selected in such a manner that they lie preferably in the region of recesses 7 of folding means 5 entering into folding jaw gap 12. In this manner, it is ensured on one hand that, with folding means 5 being inserted, a contact force acting upon the currently forming folding spine, that is an engagement on contact surface 15 of stationary folding jaw part 13 of folding jaw arrangement 11, are already attainable via the resilient regions. Because of this, it is guaranteed that multilayer products to be cross-folded are also held in folding jaw gap 12 of folding jaw arrangement 11 configured according to the present invention. On the other hand, the selected arrangement makes it possible to ensure that folding means 5, which carries out a swivel motion while it is retracted from the pushed-in product, i.e., the folding blade with its tip 6 moves out of the folding spine, for example in the case of multilayer products, in a smooth and careful manner without impairing the quality of the products.

Reference numeral 34 denotes the region in which lateral surface 9 is provided with longitudinal grooves into which tips 30, 33 of the stripper or lifter elements plunge which, while folding jaw 14 is open, remove the cross-folded products from lateral surface 9 of product-carrying cylinder 10 again and feed them to a conveying device for further processing.

Figure 3:
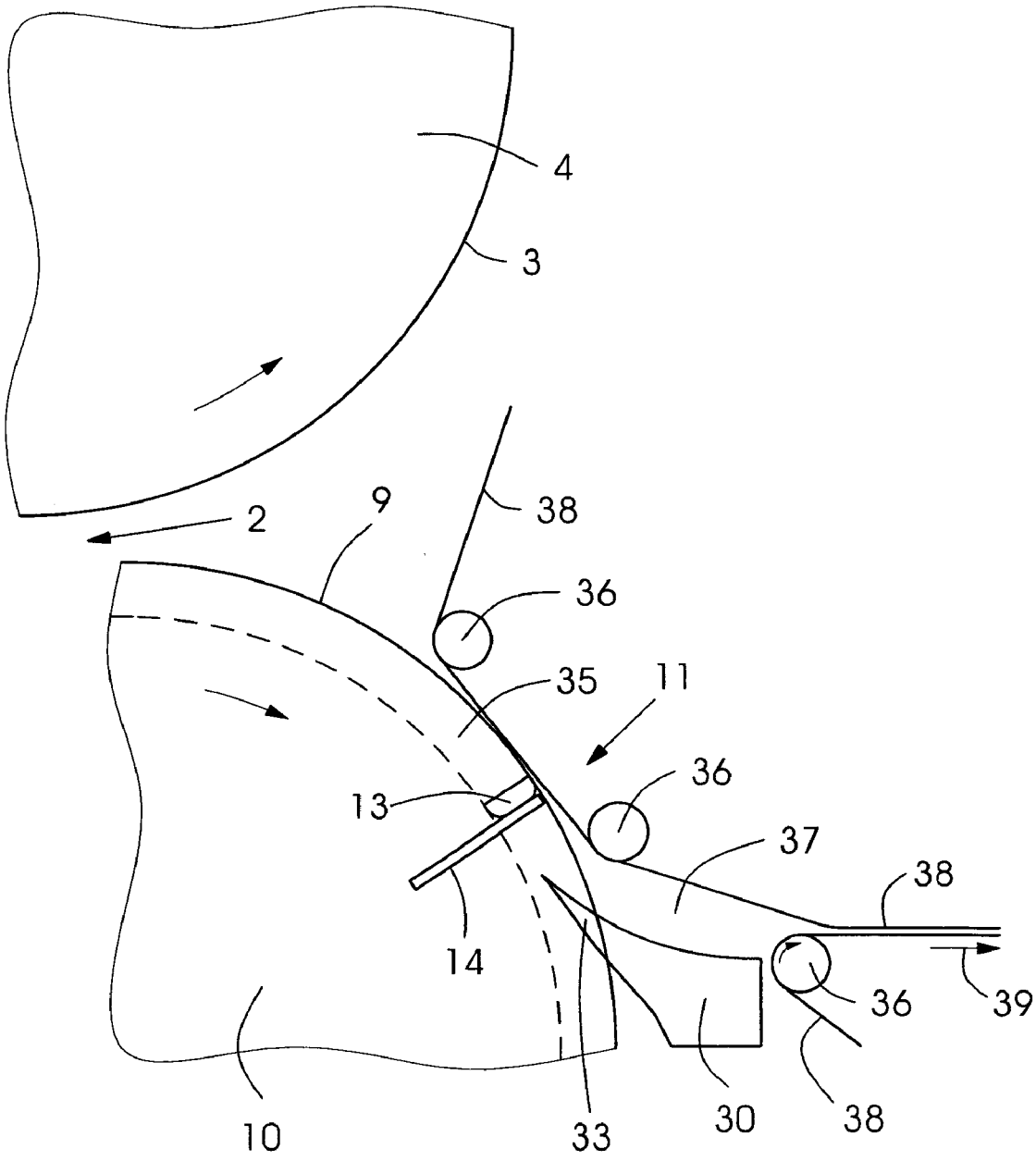
FIG. 3 shows the product exit region at the folding jaw cylinder including lifter elements.

A product exit region at the folding jaw cylinder with lifter elements is illustrated in greater detail in the representation according to FIG. 3.

According to the representation of FIG. 3, folding blade cylinder 4 rotates counterclockwise, products having passed in transfer gap 2 from lateral surface 3 thereof to lateral surface 9 of the product-carrying cylinder, i.e., of folding jaw cylinder 10, during the cross-folding process. As represented in FIG. 3, folding jaw cylinder 10 rotates clockwise and conveys the products held in closed folding jaws 11 in the direction of a product exit 39. Conveyer belts 31, 38, whose conveying path is depicted only schematically according to the representation in FIG. 3, co-operate with lateral surface 9 of folding jaw cylinder 10. Conveyer belts 31, 38 make contact with lateral surface 9 of folding jaw cylinder 10. When folding jaw arrangement 11 opens, that is, when movable part 14 of folding jaw arrangement 11 turns away from stationary part 13 of folding jaw arrangement 11, the folding spine moves out of the open folding jaw due to the inherent flexural stiffness of the single- or multilayer product and can be lifted off by the tip of one or a plurality of lifter elements 30 entering into longitudinal grooves 34, 35 at lateral surface 9 of folding jaw cylinder 10, and can enter into entry gap 37. Entry gap 37 is formed by an upper, preferably slightly curved, cheek-shaped section of lifter element 30 and conveyer belts 38 running opposite thereto. The folding spine of the leading portion released from lateral surface 9 and from folding jaw 11, that is, the folding spine of the cross-folded product, enters into the entry gap and is conveyed to a product exit 39 via conveyer belts 38. Depending on the number of longitudinal grooves 34, 35 provided in lateral surface 9 of the folding jaw cylinder, provision can be made for a plurality of lifter or stripper elements 30 extending over the width of folding jaw cylinder 10.

Depth 32 (FIG. 2) to which lifter tip 33 of stripper or lifter elements 30 plunges is variable and can be adjusted depending on the production requirements. Conveyer belts 38 run around guide rollers 36 of which some are driven and some are only idling. Movable part 14 of folding jaw arrangement 11 opens in the region in which lateral surface 9 is covered by conveyer belts 38, 31 disposed opposite. During the opening of movable folding jaw 14 and the resulting release of the folded spine of the product by folding jaw arrangement 11, no relative velocity differences exist between lateral surface 9 and conveyer belts 38, 31 so that no marking phenomena occur during the removal of the products from lateral surface 9 of folding jaw cylinder 10.

Figure 4:
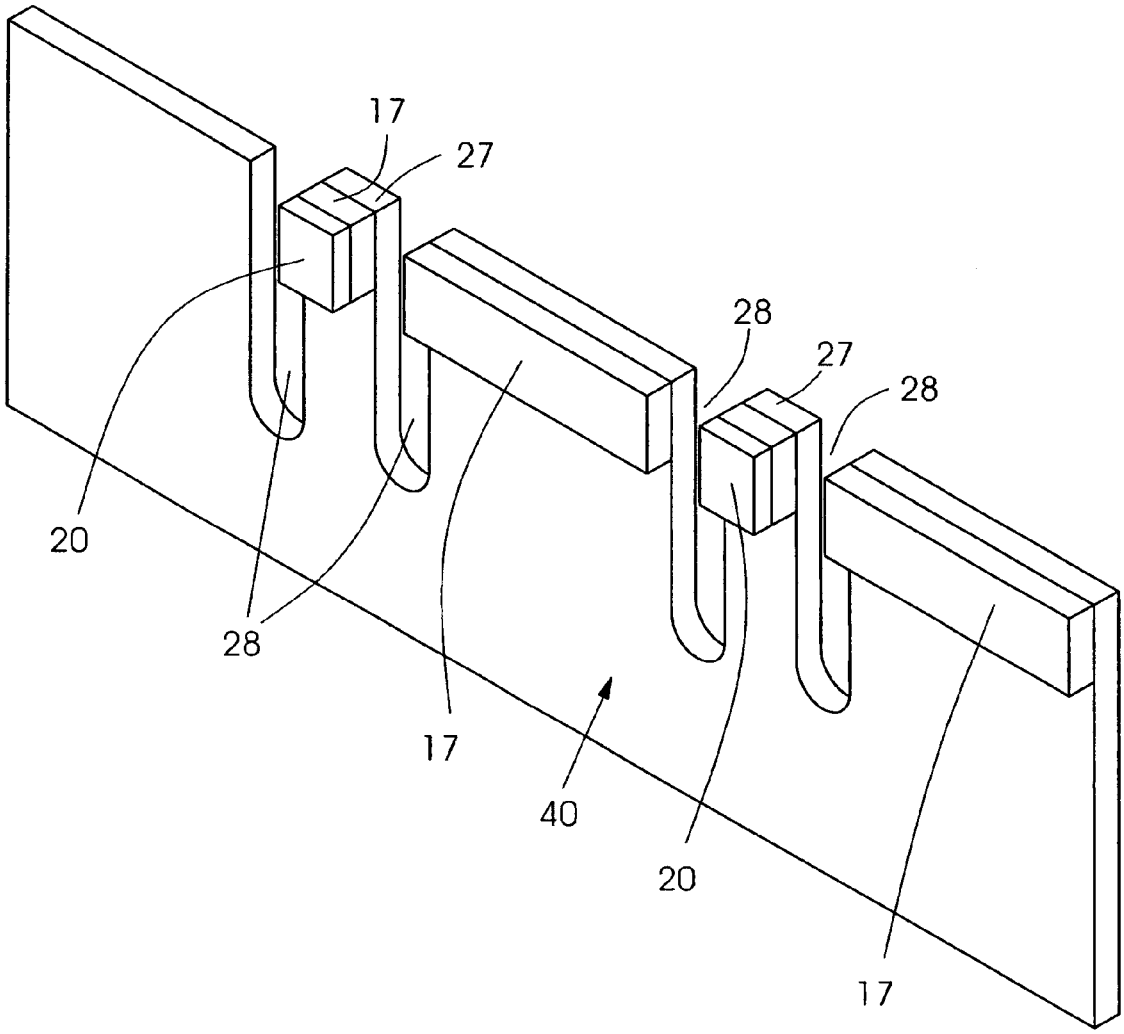
FIG. 4 shows a movable folding jaw part formed in one piece having resilient sections which feature a coating formed with overthickness.

A movable folding jaw part 14 which is formed in one piece and features resilient sections 27 is illustrated in greater detail in the representation according to FIG. 4.

The perspective view shows a flat-spring-shaped movable, one-piece folding jaw part 40 whose upper region accommodates an intermediate coating 17 facing lateral surface 9 of folding jaw cylinder 10. The intermediate coating is preferably composed of an elastic, flexible material such as a polyurethane. Besides flexible material as, for example, polyurethane, it is also possible to use extremely wear-resistant material such as sapphire or carbon. Apart from polyurethane, other materials as, for example, rubber, natural rubber, or synthetic materials can be used as well. Folding jaw part 40, which is formed in one piece, is provided with separate slot-shaped openings 28 bounding resilient sections 27. In the region of resilient sections 27, a coating 20 which is also composed of an elastic, flexible material such as polyurethane is applied with overthickness to intermediate layer 17. This coating is depicted in an enlarged view in the representation according to FIG. 4. Thickness 23 of additional coating 20 is markedly smaller in comparison with intermediate layer 17. Via additional coating 20, it is achieved that a holding force which acts only pointwise upon the folding spine of the product located in folding jaw gap 12 is produced early as movable folding jaw part 40 formed in one piece is brought into contact with stop face 15 of stationary part 13 of folding jaw arrangement 11. In this manner, it is possible to prevent marking phenomena due to excessive compression of the folding spine. In the case of multi-page folded products (such as products having 8, 12, 16, 32 or 64 pages), the side of the sheet-like product lying against lateral surface 3 of the folding blade cylinder disposed opposite can be prevented from moving out of the folding jaw again due to the increased holding force exerted upon the spine of the product to be folded.

The producible holding force depends on thickness 23 of additional coating 20 and on the flexural stiffness which is inherent in resilient regions 27, which are preferably designed as resilient tongues. The flexural stiffness of resilient tongues 27 can be predetermined via the length of slot-shaped openings 28 in movable folding jaw part 40. It is rated such that multilayer products of folded products can also reliably held against contact surface 15 of stationary folding jaw part 13 disposed opposite of movable folding jaw part 40. The thicker the folding spine of the multilayer product developing during the cross-folding process, the larger are the holding forces which can be produced using the embodiment according to the present invention of movable folding jaw part 13, 29, 40.

FIG. 5.1 shows a folding jaw in the open condition.

Flexible, elastic intermediate layer 17 is shown in an exaggerated form shifted upward in dashed representation with respected to movable folding jaw part 14. In this manner, it is indicated that additional coating 20 with its side 22 facing the product and intermediate layer 17 featuring elastic properties are located in different planes relative to each other. In the open position of folding jaw 11, folding jaw gap 12 is bounded contact surface 15 of stationary folding jaw 13 and product-facing side 22 of coating 20 on movable folding jaw part 14.

FIG. 5.2 reveals a movable folding jaw part 14 making contact with stationary folding jaw 13 and lying against contact surface 15. Due to intermediate layer 17, product-facing side 22 of coating 20 comes earlier into contact with contact surface 15 of stationary folding jaw 13 in comparison with the regions of movable folding jaw part 14 which do not have these coatings 17, 20. During the approach movement of movable folding jaw part 14 toward contact surface 15 of stationary folding jaw 13 in the direction of the arrow drawn in, the resilient tongues, whose top region accommodates coatings 17, 20, are deflected when the product is grasped in folding jaw gap 12 as indicated in FIG. 5.2. The holding force which holds the product in folding jaw gap 12 and prevents a moving out of several pages of the multi-page products while folding means 5 is retracted from folding jaw gap 12 is produced in the contact area of the sheet-like product between contact surface 15 of stationary folding jaw 13 and product-facing side 22 of coating 20 of movable folding jaw part 14.

The fold in the sheet-like product to be folded produced by pushing the sheet-like product into folding jaw gap 12 via folding means 5 as, for example, a folding blade, can be effected in the region between the leading edge and the trailing edge of the sheet-like product as, for example, exactly in the middle, at a third (delta or double gate fold), in the top region, in the region of the trailing end of a product having 8, 12, 16, 32 or 64 pages, depending on the set folding mode.

"Resilient" material as defined herein is a material that is spring elastic, and tends to return to its original position.

LIST OF REFERENCE SYMBOLS

1 Normal
2 Transfer gap
3 Lateral surface of folding blade cylinder
4 Cylinder (folding cylinder (double parallel))
5 Folding means
6 Tip of folding means
7 Recess
8 Moving direction of folding means
9 Lateral surface of product-carrying cylinder
10 Product-carrying cylinder (folding jaw cylinder)
11 Folding jaw arrangement
12 Folding jaw gap
13 Stationary folding jaw part
14 Movable folding jaw part
15 Contact surface
16 Tip of folding jaw
17 Elastic intermediate layer
18 Back
19 Front
20 Additional coating
21 Adhesion side
22 Product-facing side
23 Thickness
24 Moving direction
25 Fastening opening
26 Clearance
26*a* Clearance in the individual sections of FIG. 2
27 Resilient tongue
28 Slot-shaped opening
29 Section of movable folding jaw
30 Lifter element
31 Conveyer belt
32 Entering depth
33 Lifter tip
34 Clearance
35 Groove of lateral surface
36 Guide roller
37 Entry gap
38 Conveyer belt
39 Product exit
40 One-piece folding jaw part
41 First distance
42 Second distance

What is claimed is:

1. A folding jaw arrangement on a folding jaw cylinder in a folding apparatus of a rotary printing press, comprising:

a stationary folding jaw part; and a movable folding jaw part, the movable folding jaw part and the stationary folding jaw part defining a gap, a folding device of a further cylinder co-operating with folding jaw cylinder entering the gap for folding a printed product, the movable folding jaw part being provided with at least one resilient region, the resilient region pressing the product against the stationary folding jaw part during a folding process; the movable folding jaw part further including an additional coating narrowing the gap at the resilient region.

2. The folding jaw arrangement as recited in claim 1 wherein the movable folding jaw part includes a plurality of folding jaw sections arranged side by side over a width of the folding jaw arrangement.

3. The folding jaw arrangement as recited in claim 1 wherein the movable folding jaw part is designed as a one-piece part.

4. The folding jaw arrangement as recited in claim 1 wherein the at least one resilient region is designed as resilient tongues bounded by slot-shaped openings.

5. The folding jaw arrangement as recited in claim 1, wherein the additional coating includes an elastic, flexible material having an increased coefficient of friction with respect to a coefficient of friction of a material of the printed product.

6. The folding jaw arrangement as recited in claim 5, wherein the additional coating contains a polyurethane.

7. The folding jaw arrangement as recited in claim 1, wherein the additional coating is arranged in an upper region of the movable folding jaw part, the upper region facing a lateral surface of the folding jaw cylinder.

8. The folding jaw arrangement as recited in claim 1, wherein the additional coating is connected directly to the movable folding jaw part.

9. The folding jaw arrangement as recited in claim 1, wherein the additional coating is accommodated on an intermediate layer on the movable folding jaw part.

10. The folding jaw arrangement as recited in claim 9, wherein the intermediate layer contains an elastic, flexible material.

11. The folding jaw arrangement as recited in claim 1, wherein the movable folding jaw part includes recesses permitting passage of lifter elements.

12. The folding jaw arrangement as recited in claim 1, wherein the resilient region of the movable folding jaw part corresponds to recesses formed on the folding device entering into the gap in such a manner that the resilient region, via the recesses in the folding device, press the product against the stationary folding jaw part of the folding jaw arrangement and hold it thereon while the folding device is retracted.

13. A folding jaw cylinder in a folding apparatus of a printing press comprising a folding jaw arrangement, the folding jaw arrangements including:

a stationary folding jaw part; and a movable folding jaw part, the movable folding jaw part and the stationary folding jaw part defining a gap, a folding device of a further clylinder co-operating with folding jaw cylinder entering the gap for folding a printed product, the movable folding jaw part being provided with at least one resilient region, the resilient region pressing the product against the stationary folding jaw part during a folding process; the movable folding jaw part further including an additional coating narrowing the gap at the resilient region.

14. A folding apparatus of a printing press comprising a folding jaw cylinder having a folding jaw arrangement, the folding jaw arrangement including;

a stationary folding jaw part; and a movable folding jaw part, the movable folding jaw part and the stationary folding jaw part defining a gap, a folding device of a further cylinder co-operating with folding jaw cylinder entering the gap for folding a printed product, the movable folding jaw part being provided with at least one resilient region, the resilient region pressing the product against the stationary folding jaw part during a folding process; the movable folding jaw part further including an additional coating narrowing the gap at the resilient region.

* * * * *